US008302283B2

(12) United States Patent
Bobenhausen

(10) Patent No.: US 8,302,283 B2
(45) Date of Patent: Nov. 6, 2012

(54) METHOD AND APPARATUS FOR CONNECTING A HOSE TO A FITTING

(76) Inventor: Larry F. Bobenhausen, St. Petersburg, FL (US)

( * ) Notice: Subject to any disclaimer, the term of this patent is extended or adjusted under 35 U.S.C. 154(b) by 467 days.

(21) Appl. No.: 12/634,882

(22) Filed: Dec. 10, 2009

(65) Prior Publication Data

US 2011/0138606 A1 Jun. 16, 2011

(51) Int. Cl.
*B23P 19/04* (2006.01)
*B23Q 3/00* (2006.01)

(52) U.S. Cl. ..... 29/464; 29/237

(58) Field of Classification Search ..... 29/525.01, 29/237, 278, 267, 268, 428, 464, 468, 469.5, 29/505, 508

See application file for complete search history.

(56) References Cited

U.S. PATENT DOCUMENTS 6,206,048 B1 3/2001 Bobenhausen
7,114,229 B1 * 10/2006 Nago ..... 29/237

* cited by examiner

*Primary Examiner* — John C Hong
(74) *Attorney, Agent, or Firm* — Larson & Larson, P.A.; Frank Liebenow; Justin Miller

(57) ABSTRACT

An application for a clamp tool that has stop edges and ear edges. In one embodiment, stop edges close against each other while the ear edges, being cut deeper than the stop edges, do not touch each other and provide a space between which an ear of a clamp is position and closed by the clamp tool without cutting or nicking unnecessarily into the ear of the clamp. In some embodiments, the width of the stop edges is made to provide an alignment tool for proper alignment of the clamp on a hose over features of a fitting.

18 Claims, 8 Drawing Sheets

METHOD AND APPARATUS FOR CONNECTING A HOSE TO A FITTING

FIELD

This invention relates to a method for connecting a hose to a fitting. More particularly, it refers to a method of connecting a hose to a fitting using one or more clamps.

BACKGROUND

Air conditioning hose assembly connection systems are known. The simplest is to fit an end of a flexible, compressible hose over a metal fitting or stem and attaching clamps on the hose over the fitting to hold the hose to the fitting and to prevent leaks in various applications such as with high pressure refrigerants. Often, this is not sufficient for such high pressure connections because the hose tends to slip off the fitting. To improve this type of connection, the fitting is made with one or more ridges or beads that help hold the hose to the fitting. Still, in high-pressure applications, it is still possible for the hose to come free from the fitting.

To further improve the connection, guides have been deployed to guide the installation of the clamps such that the clamps situate themselves between the ridges/beads, making it even more difficult for the hose to slip off of the fitting.

What is needed is a tool that aligns the clamps between the ridges/beads without the need for guides and the tool needs to provide force to tighten the clamp.

SUMMARY

A clamp tool has stop edges and ear edges. The stop edges close against each other while the ear edges, being cut deeper than the stop edges, do not touch each other and provide a space between which an ear of a clamp is position and later closed by the clamp tool without cutting or nicking unnecessarily into the ear of the clamp. In some embodiments, the width of the stop edges is made to provide an alignment tool for proper alignment of the clamp on a hose over features of a fitting.

The invention includes a clamp tool that has a first member and a second member. The first member is pivotally coupled to the second member forming pliers. A first head is at a first end of the first member and a second head is at the first end of the second member. A first handle is at a second end of the first member and a second handle is at the second end of the second member. The first head has first stop edges and a first ear edge positioned between the first stop edges while the second head has second stop edges and a second ear edge positioned between the second stop edges. In a closed position, the first stop edges press against the second stop edges and the first ear edge is spaced apart from the second ear edge thereby providing a gap in which an ear of a clamp is positioned and fits.

In another embodiment, a method of joining a flexible hose to a rigid, hollow shaft is disclosed. The rigid, hollow shaft has at least one bead and a stop whereby clamp placement needs to not overlap any of the at least one bead. The method steps include (a) providing a clamp tool that has a first member and a second member, the first member pivotally coupled to the second member forming pliers. The tool has a first head at a first end of the first member and a second head at the first end of the second member and has a first handle at a second end of the first member and a second handle at the second end of the second member. The first head has first stop edges and a first ear edge positioned between the first stop edges. The second head has second stop edges and a second ear edge positioned between the second stop edges. The method continues with (b) providing an end of the flexible hose cut at 90 degrees and (c) placing at least one hose clamp loosely over the flexible hose then (d) pushing the end of the flexible hose over the rigid, hollow shaft, the end of the flexible hose abutting the stop. (e) The stop edges of the clamp tool are opened and (f) an ear of a first hose clamp is positioned between the first ear edge and the second ear edge. (g) An edge of the first head and of the second head are aligned in line with the end of the flexible hose (or stop or index/reference mark), thereby positioning the first hose clamp properly between the stop and a first bead of the at least one bead. (h) A closing force is exerted between the first handle and the second handle, thereby compressing the ear of the first hose clamp and compressing the hose between the stop and the first bead.

In another embodiment, a clamp tool is disclosed having a way to open and to close, applying closing pressure between a first head and a second head (e.g., a handle, pneumatic or other device) when closed. The first head has first stop edges and a first ear edge positioned between the first stop edges and the second head has second stop edges and a second ear edge positioned between the second stop edges. In a closed position, the first stop edges press against the second stop edges and the first ear edge is aligned and spaced apart from the second ear edge thereby providing a gap in which an ear of a clamp fits.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
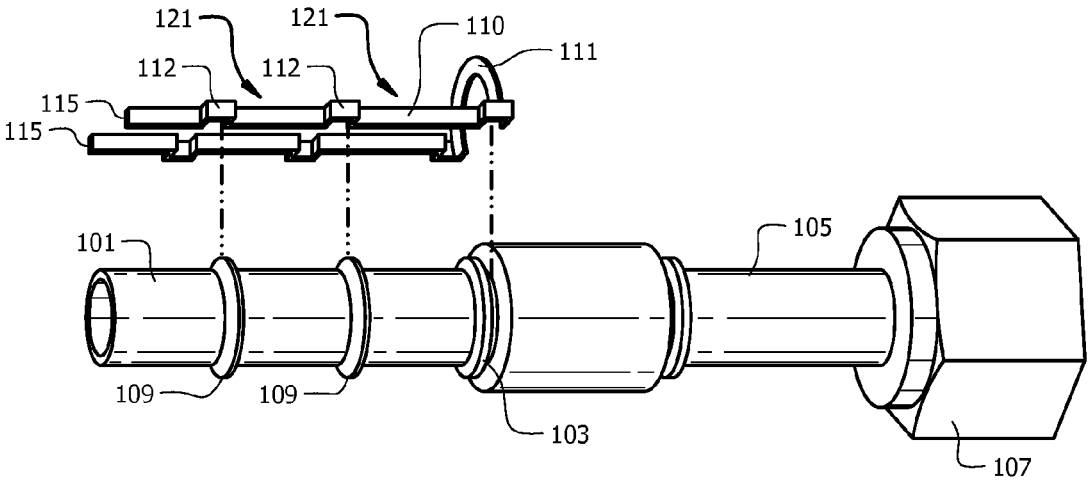
FIG. 1 (Prior Art)
FIG. 1 illustrates a clamp guide of the prior art.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a perspective view of a clamp guide 110 of the prior art is shown. The prior art for connecting a flexible hose to a rigid, hollow shaft 101/105 includes a clamp guide 110 as shown in FIG. 1. The clamp guide 110 has registration areas 121 between ridges 112 that align with beads 109 on a typical hose-connection end 101 of the rigid, hollow shaft 101/105. In this example, the clamp guide 110 has a semi-circular portion 111 that fits inside a groove 103 in the rigid hollow shaft 101/105 so that the clamp guide arms 115 are on opposite sides of the flexible hose (not shown) when the flexible hose is positioned over the receiving end 101 of the rigid, hollow shaft 101/105. The rigid, hollow shaft 101/105 is anticipated to be a component of a variety of connectors and fittings, one example is shown having a threaded fitting 107 at an end 105 distal from where a flexible hose is attached using the clamp guide 110 and clamps (not shown).

When installing the clamps (not shown) on the hose (also not shown), it is important that the clamps align with the gaps between the beads 109 to provide maximum burst force. Otherwise, the clamp will be aligned over one of the beads 109 and will not hold the hose correctly to the hollow shaft 101 and, under pressure, the hose will pull away from the hollow shaft 101. The guides 110 help align the clamps for maximum operating pressure. In this method, the installer is required to maintain an inventory of different guides, for different fittings making it is possible for an installer to use the wrong guide, creating a weak joint between the hose and the fitting.

Figure 2:
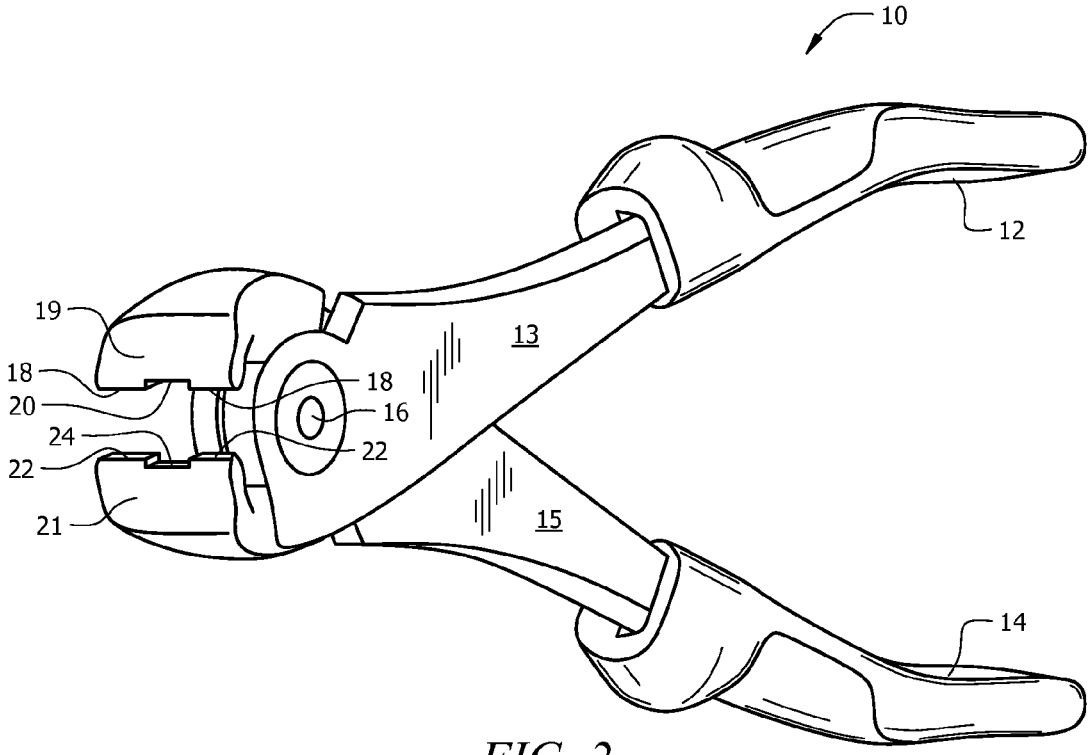
FIG. 2 illustrates a perspective view of an embodiment of a clamp tool.
Figure 3A:
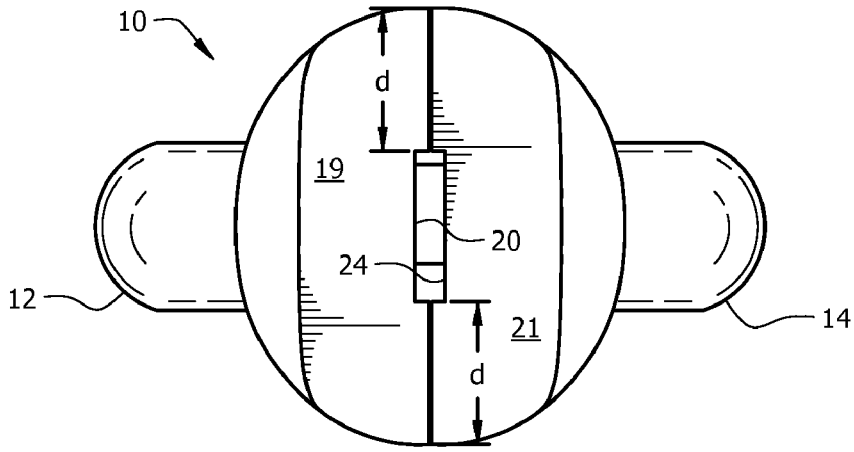
FIG. 3A illustrates a top plan view of an embodiment of the clamp tool in a closed position.
Figure 3B:
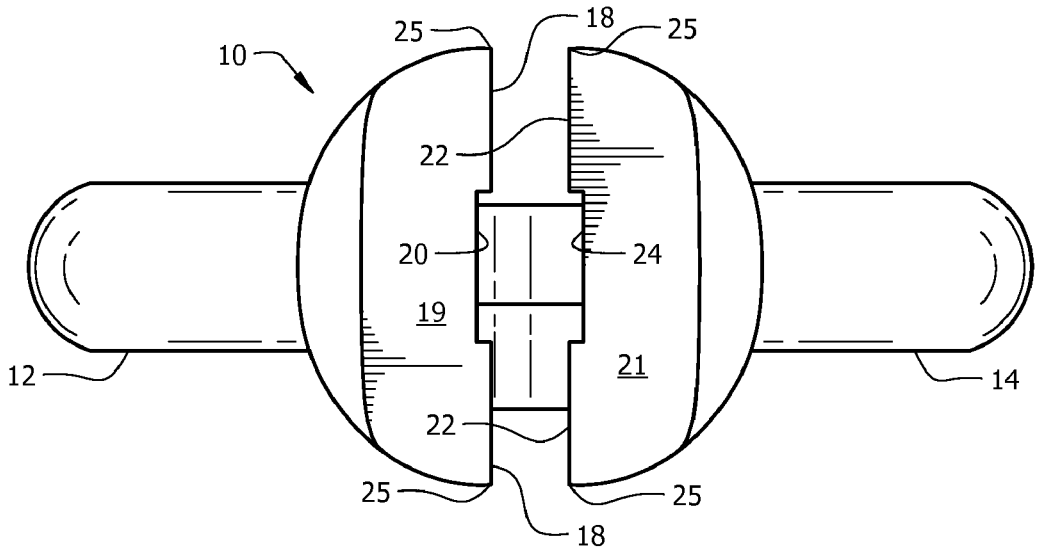
FIG. 3B illustrates a top plan view of an embodiment of the clamp tool in an open position.

Referring to FIGS. 2, 3A and 3B, perspective views of an embodiment of a clamp tool 10 are shown. The clamp tool 10 has two members 13/15 with handles 12/14 at one end for holding and for exerting pressure by a user. The members 13/15 provide force to opposing heads 19/21 at the other end of the members 13/15, being fulcrums coupled by a pivot 16 such as a typical wire cutter or other pliers. The mating edges 18/20/22/24 of the opposing heads 19/21 are formed for a given hose clamp 40/42 (see FIGS. 4A/4B also referred to as Pinch-clamps, Click-clamps, O-Clips, O-Clamps, Ear-Clamps or Ear-Clips, etc) and fitting (see FIGS. 6/7). In that, the ear interface edges 20/24 that mate with the hose clamp ear 42 are recessed. Since the ear interface edges 20/24 are recessed inward of the stop edges 18/22, the ear interface edges 20/24 don't cut into the hose clamp ear 42 when the clamp tool 10 is closed. This is shown in FIG. 3A, in which the opposing heads 19/21 of the clamp tool 10 are in a closed position having a gap between the ear interface surfaces 20/24. FIG. 3B shows the clamp tool 10 in an open position ready to accept the ears 42 of a hose clamp 40/42. As will be shown in FIGS. 5A and 5B, in some embodiments, the width, d, of the stop edges 18/22 provide a reference or fixed distance between the sides 25 of the clamp tool 10 and the ear interface surfaces 20/24. This width, d, corresponds to the correct placement of the clamp 40/42 with respect to an edge 79 of the hose 78, an index/reference line (not shown) or bead 60 of the fitting 62. This enables correct alignment of the hose clamp 40/42 with, for example, the fitting 62 elements. Many clamp tool 10 sizes are anticipated for different fitting 62 sizes and different clamp 40/42 sizes.

In some embodiments, the ear interface surfaces 20/24 are held apart by a mechanism associated with the members 13/15, handles 12/14 and the pivot 16, not requiring the stop edges 18/22 to touch. Such mechanisms are known in the industry, for example, a pin in one member 13 and a slot in the second member 15 such that the pin reaches the end of the slot before the stop edges 18/22 meet. In some versions of this embodiment, the stop edges 18/22 are not included and in alternate embodiments of this, marks are made to indicate a location or center for locating the ear 42 of the clamp 40 during compression.

In some embodiments, only one stop edge 18 is present.

Figure 4A:
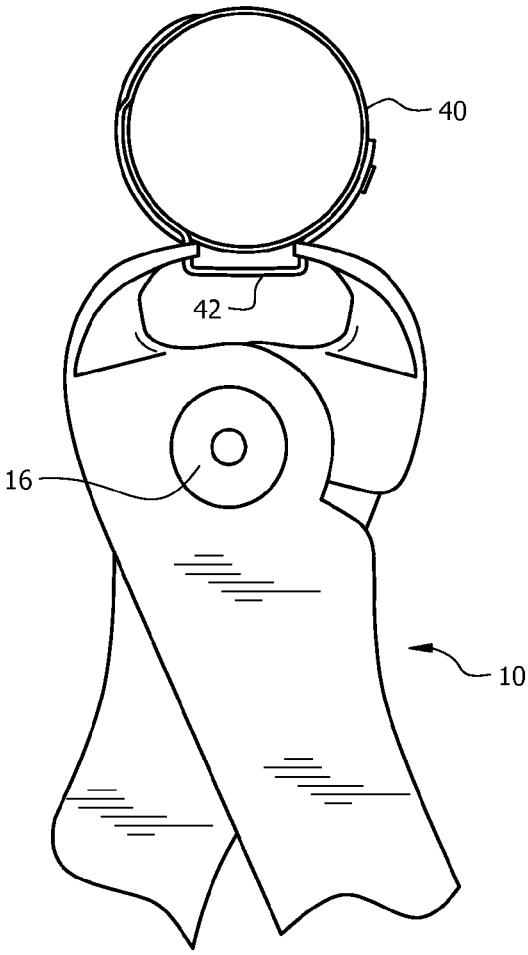
FIG. 4A illustrates a side plan view of an embodiment of the clamp tool ready to tighten a clamp in the open position.
Figure 4B:
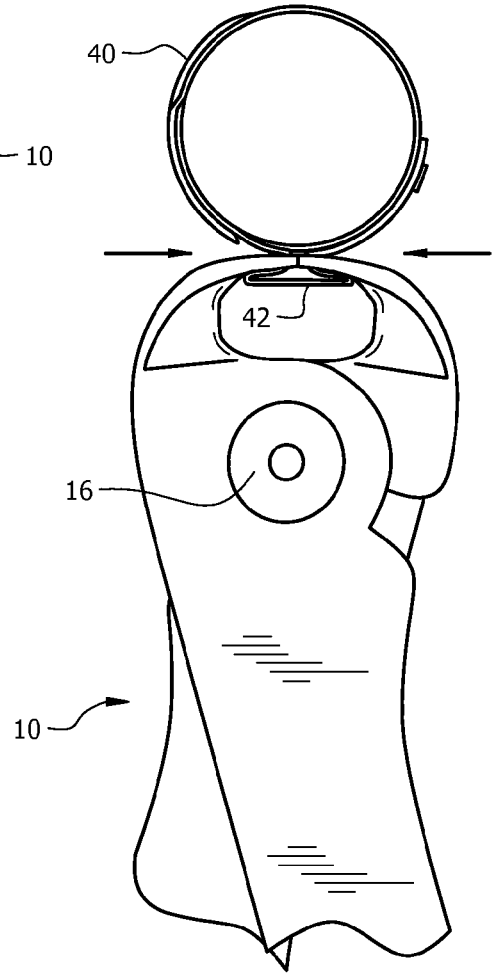
FIG. 4B illustrates a side plan view of an embodiment of the clamp tool after compression of the clamp, in the closed position.

Referring to FIGS. 4A and 4B, side plan views of an embodiment of the clamp tool 10 are shown. In FIG. 4*a*, the clamp tool 10 is ready to tighten a clamp ear 42 of a clamp 40. The ear 42 is positioned between the ear interface edges 20/24. In FIG. 4B, the clamp tool 10 has compressed the clamp ear 42 under force provided by a user pushing together the handles 12/14.

Figure 5A:
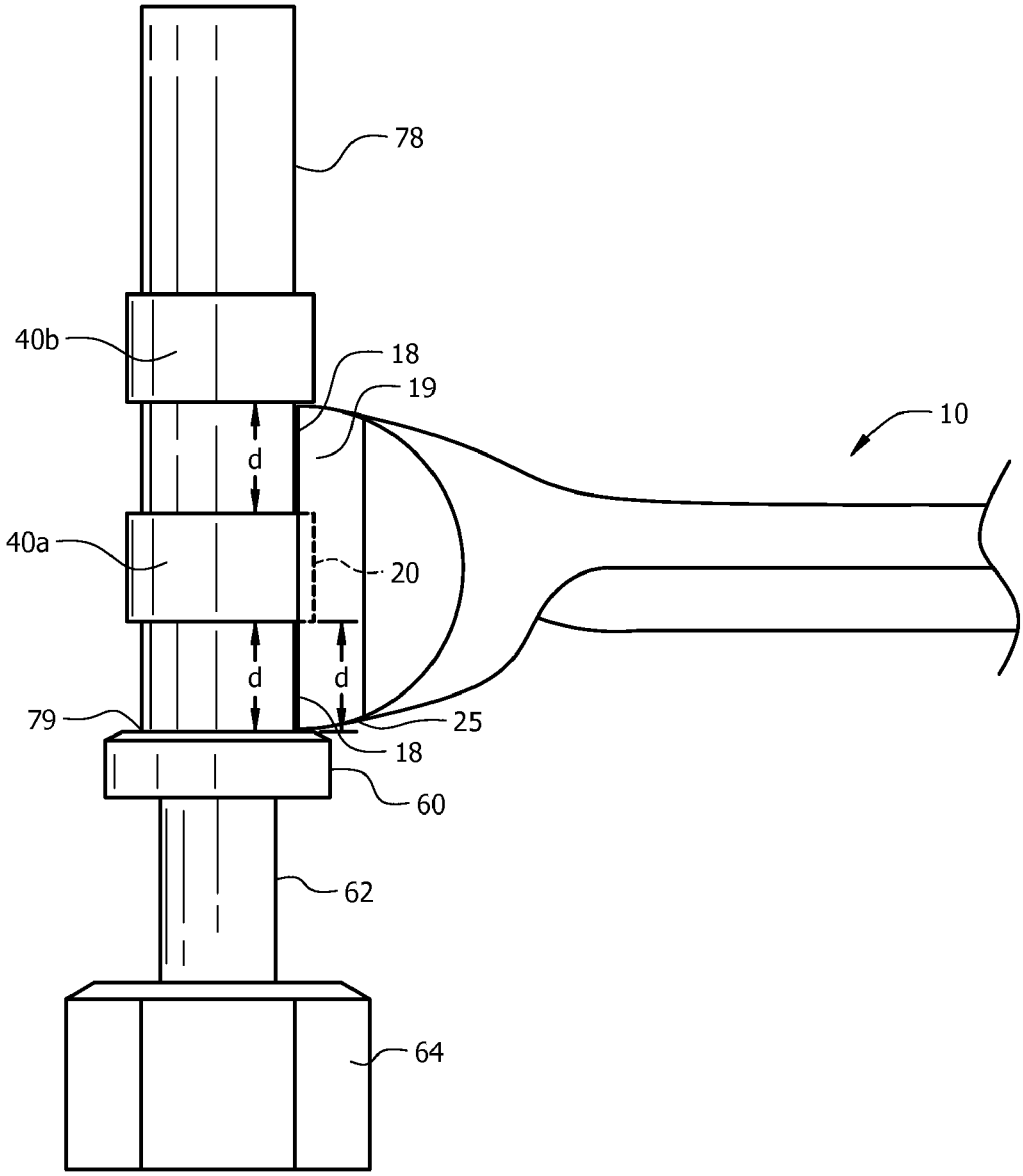
FIG. 5A illustrates a front plan view of an embodiment in use, tightening a first clamp on a hose.
Figure 5B:
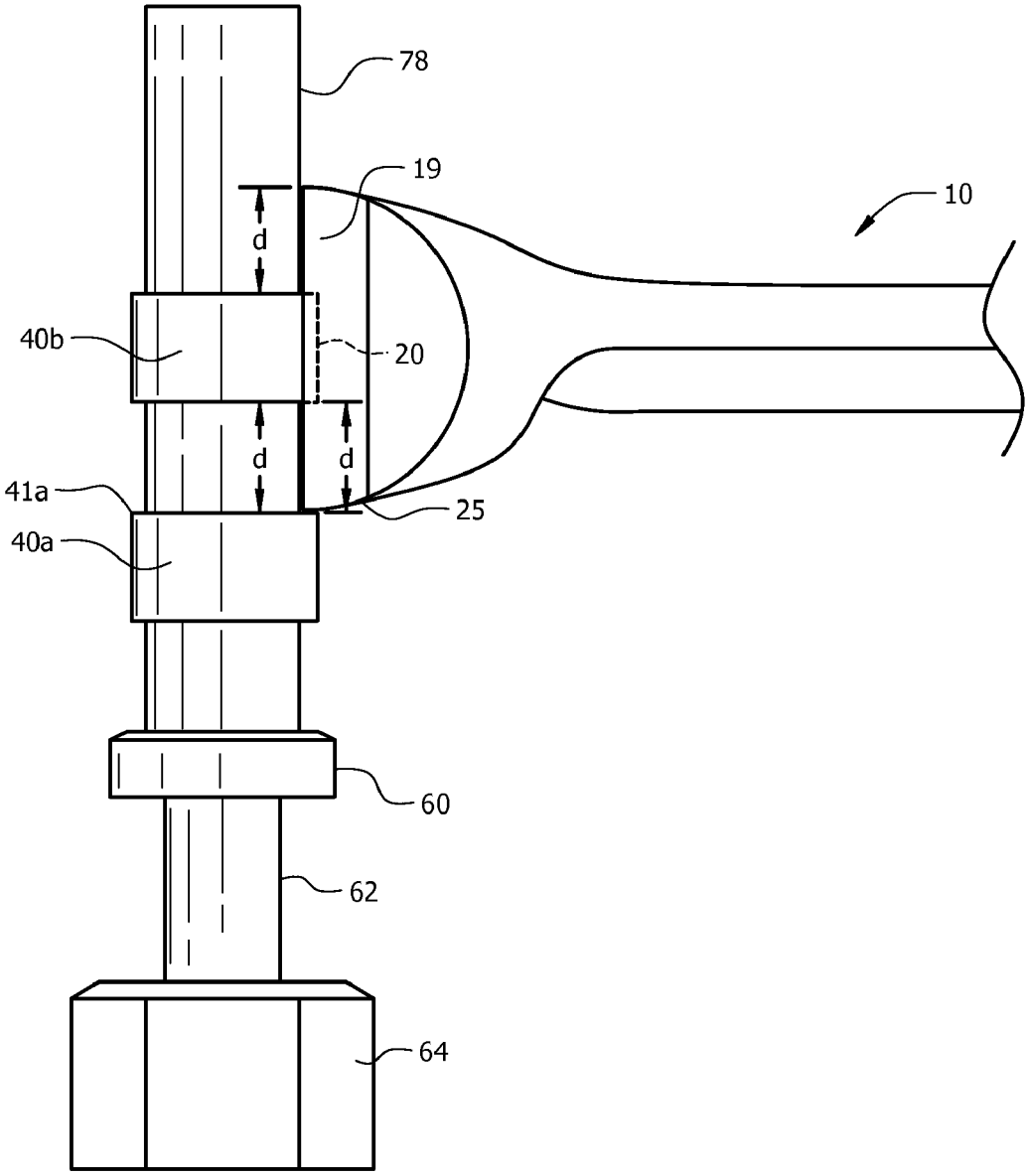
FIG. 5B illustrates a front plan view of an embodiment in use, tightening a second clamp on a hose.
Figure 6:
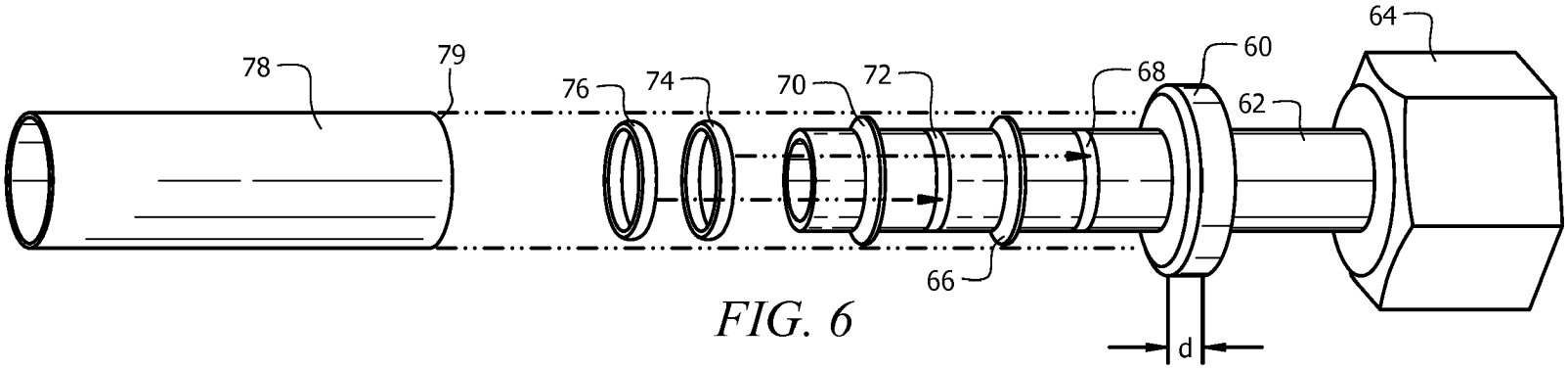
FIG. 6 illustrates a perspective view of one typical fitting.

Referring to FIGS. 5A and 5B, front plan views of the clamp tool 10 in use, tightening a first clamp 40*a* on a hose 78 are shown. The width of the stop edges 18/22 (only stop edge 18 is visible) are such that, aligning the side 25 of the clamp tool 10 with the end 79 of the hose 78 or with the stop wall 60 of the fitting 62 as shown in FIG. 5A correctly positions the first clamp 40*a* over the fitting 62. The width, d of the stop edges 18/22, is related to the correct location of the clamp 40*a* on the fitting 62. Likewise, as shown in FIG. 5B, aligning the side 25 of the clamp tool 10 with the right edge 41*a* of the first clamp 40*a* correctly positions the second clamp 40*b* on the fitting 62. The width, d of the stop edges 18/22, is related to the correct location of the clamp 40*b* on the fitting 62 with respect to the clamp 40*a*. In such, the clamp tool 10 provides correct location for one, two, three or any number of clamps 40/40*a*/40*b* on fittings made for such clamps 40/40*a*/40*b*.

It is anticipated that some embodiments have two different widths on each side of the clamp tool 10 heads 19/21 for locating clamps 40 onto different fittings 62. For example, one mating side of each head 19/21 has a first width, d, and the other mating side of each head 19/21 has a second width, d'. The first side is used to align clamps 40 on a first fitting 62 while the second side is used to align clamps 40 on a second fitting 62. It is also anticipated that multiple clamp tools 10 have different head widths, d, and each tool for a different fitting 62.

Figure 7:
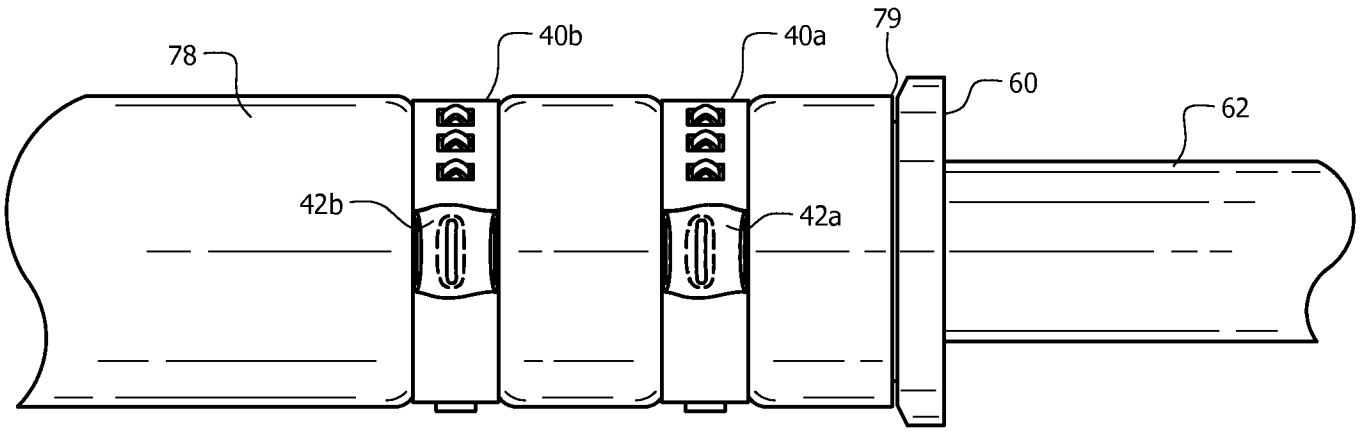
FIG. 7 illustrates a perspective view of a hose held on a typical fitting using two clamps.

Referring to FIGS. 6 and 7, a perspective view of one typical fitting is shown before assembly (FIG. 6) and after assembly (FIG. 7). The fitting 62 is an exemplary fitting and many other configurations and styles of fittings are known, all of which are anticipated by the present invention and all of which benefit from the correct alignment of the hose clamps 40/40*a*/40*b*. The fitting 62 of this example has a connector end 64 and a stop 60, to which the end of the hose 78 abuts. This fitting 62 has beads 66/70 and optional grooves 68/72 for accepting optional o-rings 74/76. During installation of the hose 78, the hose clamps 40*a*/40*b* are loosely placed over the hose 78 and then the edge 79 of the hose 78 is pushed over the fitting 62 until the edge 79 of the hose 78 abuts against the stop 60. Note, for fittings without a stop 60, a reference mark (not shown) indicates how far to push the hose 78 onto the fitting 62, thereby aligning the edge 79 of the hose 78 to the reference mark. The clamps 40*a*/40*b* are then positioned correctly and the ears 42*a*/42*b* of the clamps 40*a*/40*b* are compressed with the clamp tool 10. For maximum burst protection and minimum leakage, it is important to align the clamps 40*a*/40*b* between the beads 66/70 and between the inner-most bead 66 and the stop 60. In this way, the clamps 40*a*/40*b* compress the hose 78 between the beads 66/72 and stops 60, making it harder for the hose 78 to pull off the fitting 62. If the clamps 40*a*/40*b* are mis-aligned over, say, one of the beads 66/72, then the clamp 40*a*/40*b* cannot be tightened enough to flatten the hose 78 against the flat surface of the fitting 62 and, if provided, against the o-ring 74/76. To this means, the width of the stop edges 18/22 are made such that the widths match the distance between the stop 60 and the first clamp 40*a* when the first clamp ear 42*a* is between the ear interface edges 20/24 and/or the width matches the distance between the opposite edge of the first clamp 40*a* and the second clamp 40*b* when the second clamp ear 42*b* is between the ear interface edges 20/24.

FIG. 7 shows the final connection of the hose 78 to the fitting 62 with the first clamp 40*a*/42*a* in the proper position with respect to the end 79 of the hose 78 or the stop 60 and the second clamp 40*b*/42*b* in the proper position with respect to the first clamp 40*a*/40*b*. The position of the clamps 40*a*/40*b* having been correctly set over the proper features of the fitting 62 using the width, d, of the stop edges 18/22. For example, when O-rings 74/76 are provided, it is important to align the clamp 40*a*/40*b* approximately centered over the O-rings 74/76. Conversely, it detracts from the strength of the hose 78 and fitting 62 connection if one or more of the clamps 40*a*/40*b* are positioned over the bumps 66/70 (e.g., the clamps 40*a*/40*b* must be positioned between the bumps 66/70 for optimal strength of the hose 78 and fitting 62 connection.

It is anticipated that the stop edges 18/22 of the clamp tool 10 have, in some embodiments, flat edges 18/22 while in other embodiments, the stop edges 18/22 have pointed edges 18/22 for cutting such as for cutting wires, clamps (e.g. cutting off old clamps), etc.

Figure 8:
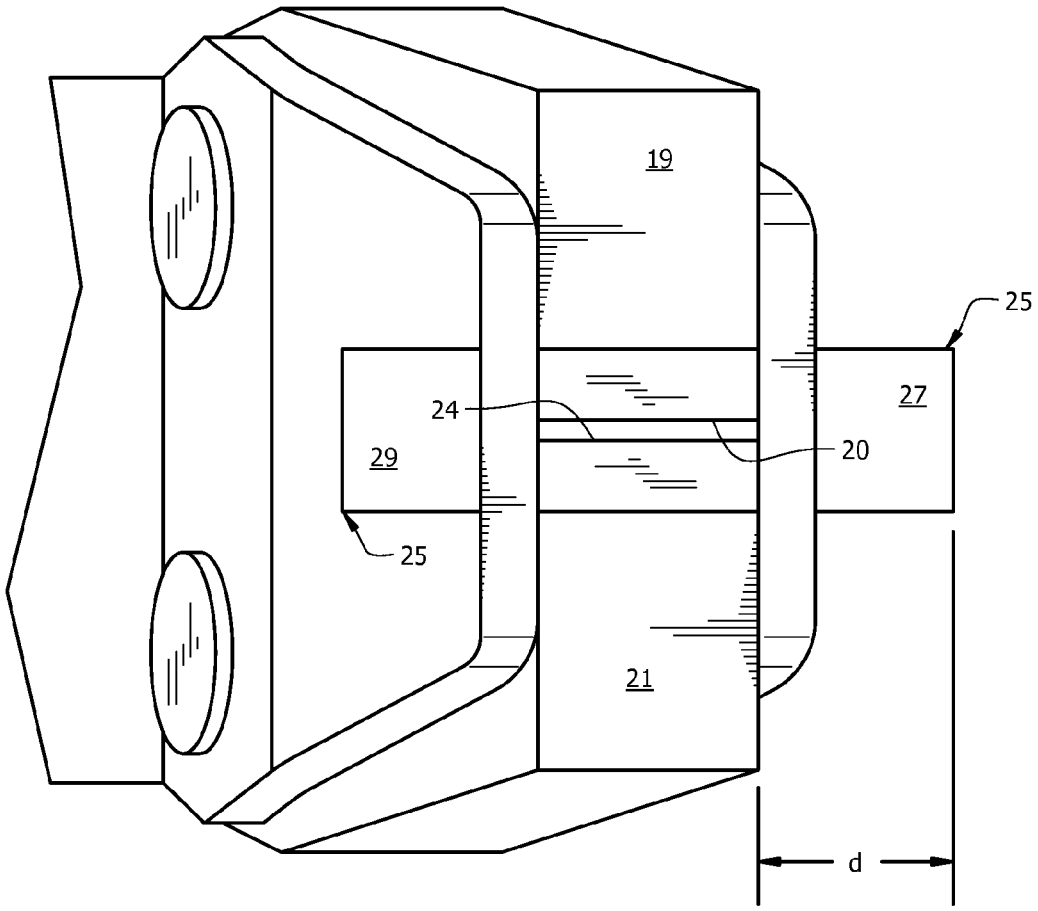
FIG. 8 illustrates a perspective view of another embodiment of a clamp tool.

Referring to FIG. 8, a perspective view of another embodiment of a clamp tool 10*a* is shown. In this embodiment, the first head 19 and the second head 21 are opened/closed by handles and/or other ratcheting devices (not shown). Although not required, it is preferred that the ear edges 20/24 are separated by a gap (as shown) when the heads 19/21 of the clamp tool 10*a* are closed, thereby reducing stress/cutting into the ear 42 of the clamp 40. In this clamp tool 10*a*, indexing extensions 27/29 extend outwardly, providing reference ends 25 which are the proper distance, d, from a reference point 60/79/41*a* (stop 60, hose end 79, previous clamp edge 41*a*, etc) in a fitting installation. In this way, when one of the indexing extensions is aligned with the reference point 60/79/41*a* and the clamp 40 is between the ear edges 20/24 and the clamp tool 10*a* is closed, the clamp 40 is tightened over the correct location/features of the underlying fitting 62, thereby providing an optimal strength connection between the fitting 62 and the hose 78.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A clamp tool comprising:

a first member and a second member, the first member pivotally coupled to the second member forming pliers;

a first head at a first end of the first member and a second head at the first end of the second member;

a first handle at a second end of the first member and a second handle at the second end of the second member;

the first head having first stop edges and a first ear edge, the first ear edge positioned between the first stop edges, the first ear edge being substantially flat; and the second head having second stop edges and a second ear edge, the second ear edge positioned between the second stop edges, the second ear edge being substantially flat;

whereas, in a closed position, the first ear edge is spaced apart from the second ear edge thereby providing a gap in which an ear of a clamp fits.

2. The clamp tool of claim 1, whereas in a closed position, the first stop edges press against the second stop edges.

3. The clamp tool of claim 1, wherein the widths of the first stop edges and the second stop edges are selected as a guide for proper placement of the clamp on a specific fitting and aligning a side edge of one of the stop edges with a reference point locates the clamp correctly with respect to the fitting.

4. The clamp tool of claim 1, wherein the first stop edges and the second stop edges are flat.

5. The clamp tool of claim 1, wherein the first stop edges and the second stop edges are pointed, thereby forming a cutting edge interface.

6. The clamp tool of claim 3, wherein the first stop edge comprises a left first stop edge and a right first stop edge and a width of the left first stop edge is a guide for proper placement of the clamp on a first type of fitting and a width of the right first stop edge is a guide for proper placement of the clamp on a second type of fitting; wherein the second stop edge comprises a left second stop edge and a right second stop edge and a width of the left second stop edge is a guide for proper placement of the clamp on the first type of fitting and a width of the right second stop edge is a guide for proper placement of the clamp on the second type of fitting and the first width is not equal to the second width.

7. The clamp tool of claim 1, wherein a width of the first ear edge and of the second ear edge is such that an ear of a clamp fits width-wise between the first and second stop edges.

8. A method of joining a hose to a rigid, hollow shaft, the rigid, hollow shaft having at least one bead and a stop, whereby optimal clamp placement is between the stop and the at least one bead or between and the at least one beads, the steps comprising:

(a) providing a clamp tool comprising:

a first member and a second member, the first member pivotally coupled to the second member forming pliers;

a first head at a first end of the first member and a second head at the first end of the second member;

a first handle at a second end of the first member and a second handle at the second end of the second member;

the first head having first stop edges and a first ear edge, the first ear edge positioned between the first stop edges;

the second head having second stop edges and a second ear edge, the second ear edge positioned between the second stop edges;

(b) providing an end of the hose cut at 90 degrees;

(c) placing at least one hose clamp loosely over the hose;

(d) pushing the end of the hose over the rigid, hollow shaft, the end of the hose abutting the stop;

(e) opening the stop edges of the clamp tool;

(f) positioning an ear of a first hose clamp of the at least one hose clamp between the first ear edge and the second ear edge;

(g) aligning an edge of the first head and of the second head in line with a reference point, thereby positioning the first hose clamp properly between the reference point and a first bead of the at least one bead; and (h) exerting a closing force between the first handle and the second handle, thereby compressing the ear of the first hose clamp and compressing the hose between the stop and the first bead.

9. The method of claim 8, wherein the reference point is the stop.

10. The method of claim 8, wherein the reference point is the end of the hose.

11. The method of claim 8, wherein the hollow shaft further includes at least one o-ring groove between the stop and the first bead, the at least one o-ring grooves is fitted with an o-ring and the step of positioning properly positions the first clamp over the o-ring.

12. The method of claim 8, further comprising the steps of:

(i) opening the stop edges of the clamp tool;

(j) positioning an ear of a second hose clamp of the at least one hose clamp between the first ear edge and the second ear edge of the clamp tool;

(k) aligning the edge of the first head and of the second head in line with an edge of the first hose clamp, thereby positioning the second hose clamp properly between a first bead and a second bead of the at least one bead; and (l) exerting a closing force between the first handle and the second handle, thereby compressing the ear of the second hose clamp and compressing the hose between the first bead and the second bead.

13. A clamp tool comprising:

a means for opening and for closing between a first head and a second head, the first head having a first ear edge, and the second head having a second ear edge;, both the first ear edge and the second ear edge are substantially flat and at least one of the first head and the second head having a means for indexing, the means for indexing providing a reference for locating a clamp over a hose, the hose inserted over a fitting end, the means for indexing, when aligned with a reference point, locating the clamp correctly with respect to the fitting;

whereby, when the means for indexing aligns with the reference point, the clamp is situated correctly on the hose with respect to features of the fitting, thereby, upon tightening, provides an optimum strength mating between the fitting and the hose.

14. The clamp tool of claim 13, wherein the reference point is an end of the hose.

15. The clamp tool of claim 13, wherein the reference point is a stop on the fitting.

16. The clamp tool of claim 13, wherein the reference point is an edge of an adjacent clamp.

17. The clamp tool of claim 13, wherein the first ear edge and the second ear edge are separated by a gap when the means for opening and from closing is in a closed position.

18. The clamp tool of claim 13, wherein a width of the first ear edge and of the second ear edge is substantially the width of an ear of the clamp.

* * * * *